US011267117B2

(12) United States Patent
Ventura et al.

(10) Patent No.: US 11,267,117 B2
(45) Date of Patent: Mar. 8, 2022

(54) STAPLE PUSHER ASSEMBLY AND METHOD OF INSTALLING SAME

(71) Applicant: ACCO Brands Corporation, Lake Zurich, IL (US)

(72) Inventors: Carlos Duarte da Costa Ventura, Arcos de Valdevez (PT); Pedro Manuel Meneses Brito Lima, Arcos de Valdevez (PT)

(73) Assignee: ACCO Brands Corporation, Lake Zurich, IL (US)

( * ) Notice: Subject to any disclaimer, the term of this patent is extended or adjusted under 35 U.S.C. 154(b) by 223 days.

(21) Appl. No.: 16/558,828

(22) Filed: Sep. 3, 2019

(65) Prior Publication Data

US 2020/0086468 A1 Mar. 19, 2020

Related U.S. Application Data

(60) Provisional application No. 62/731,203, filed on Sep. 14, 2018.

(51) Int. Cl.

| | |
|---|---|
| ***B25C 5/00*** | (2006.01) |
| ***B25C 5/16*** | (2006.01) |
| ***B25C 5/02*** | (2006.01) |

(52) U.S. Cl.
CPC ..... *B25C 5/162* (2013.01); *B25C 5/025* (2013.01)

(58) Field of Classification Search
CPC ..... B25C 5/025; B25C 5/162
See application file for complete search history.

(56) References Cited

U.S. PATENT DOCUMENTS

| | | | |
|---|---|---|---|
| 2,267,990 | A | 12/1941 | Obstfeld et al. |
| 2,328,839 | A | 9/1943 | Obstfeld et al. |
| 2,624,878 | A | 1/1953 | Marano |
| 2,702,384 | A | 2/1955 | Ruskin |
| 2,832,959 | A | 5/1958 | Pankonin |
| 2,859,442 | A | 11/1958 | Jopp |
| 3,056,584 | A | 10/1962 | Pankonin |
| 3,282,490 | A | 11/1966 | Eady |
| 3,905,535 | A | 9/1975 | Novak et al. |
| 4,762,262 | A | 8/1988 | Tsung Ming |
| D340,847 | S | 11/1993 | Bain et al. |
| 5,664,722 | A | 9/1997 | Marks |
| 5,931,364 | A | 8/1999 | Dennis |
| 6,082,604 | A | 7/2000 | Dennis |
| 7,097,086 | B2 | 8/2006 | Joyce et al. |

(Continued)

FOREIGN PATENT DOCUMENTS

| | | | |
|---|---|---|---|
| CN | 101391540 | A | 3/2009 |
| CN | 101456311 | A | 6/2009 |

(Continued)

*Primary Examiner* — Chelsea E Stinson
(74) *Attorney, Agent, or Firm* — Michael Best & Friedrich LLP

(57) ABSTRACT

A stapler includes a base, a magazine coupled to the base and configured to house staples, and a staple pusher assembly coupled with the magazine and operable to bias staples in the magazine toward a first end of the magazine where staples are driven out of the magazine. The staple pusher assembly includes a staple pusher defining a cavity, and a constant force spring having a first end coupled to the magazine and a second end that is coiled within the cavity in the staple pusher.

17 Claims, 16 Drawing Sheets

(56) References Cited

U.S. PATENT DOCUMENTS

| | | | | |
|---|---|---|---|---|
| 7,296,720 | B2 | 11/2007 | Kirby et al. | |
| 7,299,960 | B1 | 11/2007 | Marks | |
| 7,464,845 | B2 | 12/2008 | Chou | |
| 7,604,149 | B2 | 10/2009 | Tsai et al. | |
| 7,644,849 | B2 | 1/2010 | Tsai et al. | |
| 7,661,569 | B2 | 2/2010 | Matsukawa | |
| 7,828,184 | B2 | 11/2010 | Marks | |
| 7,832,609 | B2 | 11/2010 | Matsukawa | |
| 8,061,575 | B2 | 11/2011 | Joyce et al. | |
| 8,281,971 | B2 | 10/2012 | Wang et al. | |
| 8,668,128 | B2 | 3/2014 | Marks | |
| 8,899,460 | B2 | 12/2014 | Wojcicki | |
| 9,265,501 | B2 | 2/2016 | Tiwari | |
| 2006/0016847 | A1* | 1/2006 | Kirby | B25C 5/025 227/134 |
| 2014/0284369 | A1 | 9/2014 | Yang et al. | |

FOREIGN PATENT DOCUMENTS

| | | | |
|---|---|---|---|
| CN | 103128709 | A | 6/2013 |
| CN | 203330989 | U | 12/2013 |
| EP | 0543617 | A1 | 5/1993 |
| EP | 2781308 | A2 | 9/2014 |
| WO | 2014037904 | A2 | 3/2014 |

* cited by examiner

STAPLE PUSHER ASSEMBLY AND METHOD OF INSTALLING SAME

RELATED APPLICATIONS

This application claims the benefit of U.S. Provisional Patent Application No. 62/731,203 filed Sep. 14, 2018, the entire content of which is hereby incorporated by reference herein.

BACKGROUND

The present invention relates to staplers, and more specifically to the staple pusher assembly used in staplers.

SUMMARY

In one embodiment, the invention provides a stapler including a base, a magazine coupled to the base and configured to house staples, and a staple pusher assembly coupled with the magazine and operable to bias staples in the magazine toward a first end of the magazine where staples are driven out of the magazine. The staple pusher assembly includes a staple pusher defining a cavity, and a constant force spring having a first end coupled to the magazine and a second end that is coiled within the cavity in the staple pusher.

In another embodiment the invention provides a method of installing a staple pusher assembly into a stapler magazine. The method includes providing a unitized staple pusher assembly having a staple pusher and a constant force spring, a coiled end of the constant force spring being positioned within a cavity in the staple pusher, placing the unitized staple pusher assembly into the stapler magazine, and securing a non-coiled end of the constant force spring relative to the stapler magazine.

In yet another embodiment, the invention provides a staple pusher assembly including a staple pusher defining a cavity, and a constant force spring having a coiled end retained within the cavity. The coiled end of the constant force spring is retained within the cavity without any shaft or projection within the cavity on which the coiled end of the constant force spring is supported.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
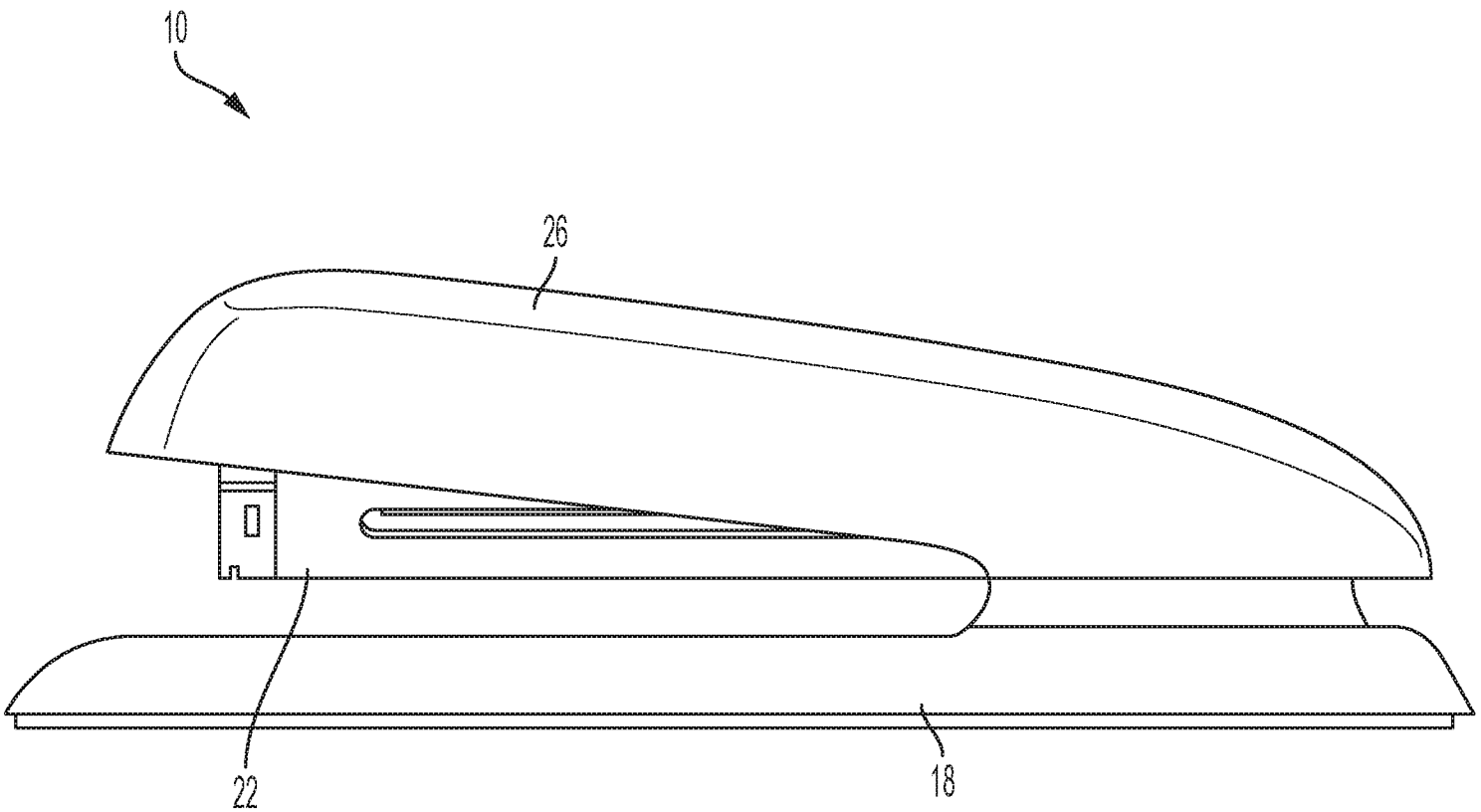
FIG. 1 is a side view of a stapler having a pusher assembly embodying the present invention.
Figure 2:
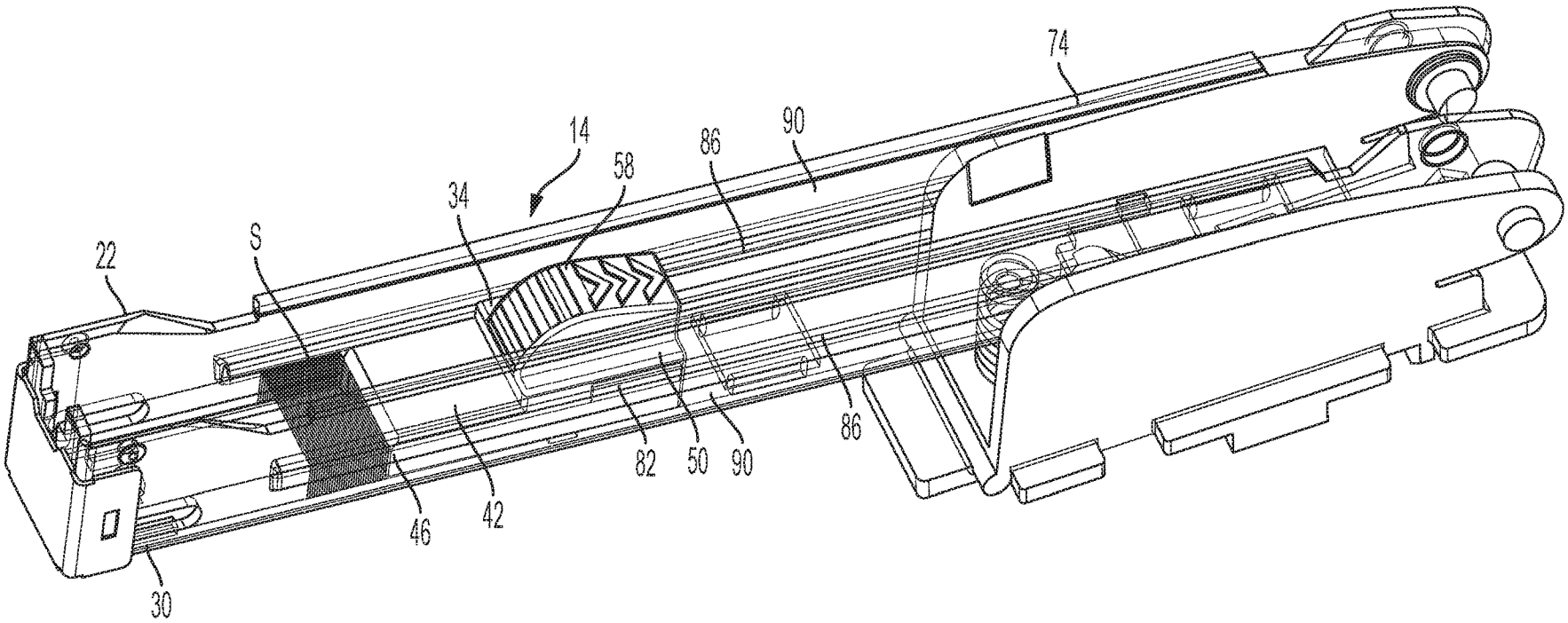
FIG. 2 is a partial perspective view of the stapler of FIG. 1 showing the pusher assembly installed in the magazine.

FIG. 1 illustrates a stapler 10 that includes a staple pusher assembly 14 according to the present invention. The stapler 10 includes a base 18, a magazine 22 pivotally coupled to the base 18, and a cover or cap 26 pivotally coupled with the base 18 and the magazine 22. In some embodiments, the magazine 22 can be coupled to the base 18 via an intervening chassis, and in some embodiments, the cover 26 can be coupled to the magazine 22 via an intervening chassis. The stapler 10 is representative of various types/models/designs of staplers (e.g., desktop, hand held, etc.) that have a magazine 22 for housing a strip of staples S (see FIG. 2) for use in stapling together one or more sheets. The pusher assembly 14 of the present invention is operable for use with most types/models/designs of staplers that utilize a magazine 22, and can be used across an entire line of stapler products, thereby minimizing the number of different parts used across the line of staplers, and optimizing and making installation more uniform from one stapler to the next.

The staple pusher assembly 14 operates to bias the strip of staples S toward a first or front end 30 of the magazine 22 where staples S are driven out of the magazine 22 into the stack of sheets. FIGS. 3-9 illustrate the components of the staple pusher assembly 14 and its interaction with the magazine 22. The staple pusher assembly 14 includes a staple pusher 34 sized and configured to fit and slide within the magazine 22, and a constant force spring 38. The staple pusher 34 includes a first end portion 42 having a distal end 46 configured to abut the last staple S in the strip of staples for pushing the staples S toward the first end 30 of the magazine. The staple pusher 34 further includes a second end portion 50 that defines a cavity 54 (see FIG. 6) formed therein for receiving at least a portion of the constant force spring 38, as will be discussed in further detail below. The illustrated second end portion 50 includes an enlarged, partially curved portion 58 configured to provide an engagement surface or area for a user to manually push, pull, or otherwise move the staple pusher 34 away from the first end 30 within the magazine 22 to load staples S. More specifically, the enlarged portion 58 includes an engagement surface 62, which in the illustrated embodiment is a forwardly and upwardly facing curved surface that can include raised ribs 66 and/or indicia 70 that provide a textured gripping surface that a user can engage with a finger or thumb to move or slide the staple pusher 34 away from the first end 30 of the magazine, toward a second or rear end 74 of the magazine. The illustrated indicia 70 take the form of arrows that point toward the second end 74 of the magazine 22, indicating to the user which direction to move the staple pusher 34 when loading additional staples into the magazine 22. In other embodiments, different texturing and indicia can be used.

The staple pusher 34 includes oppositely facing sides 78 that define side walls of the pusher 34. In the illustrated embodiment, the sides 78 extend along and define portions of both the first and second end portions 42, 50 of the pusher 34. The sides 78 each include a projection 82, which in the illustrated embodiment, takes the form of a rectangular rib or tab that is sized and configured to be received in a respective mating channel 86 formed in each side wall 90 of the magazine 22 to guide sliding movement of the staple pusher 34 within the magazine 22.

Figure 6:
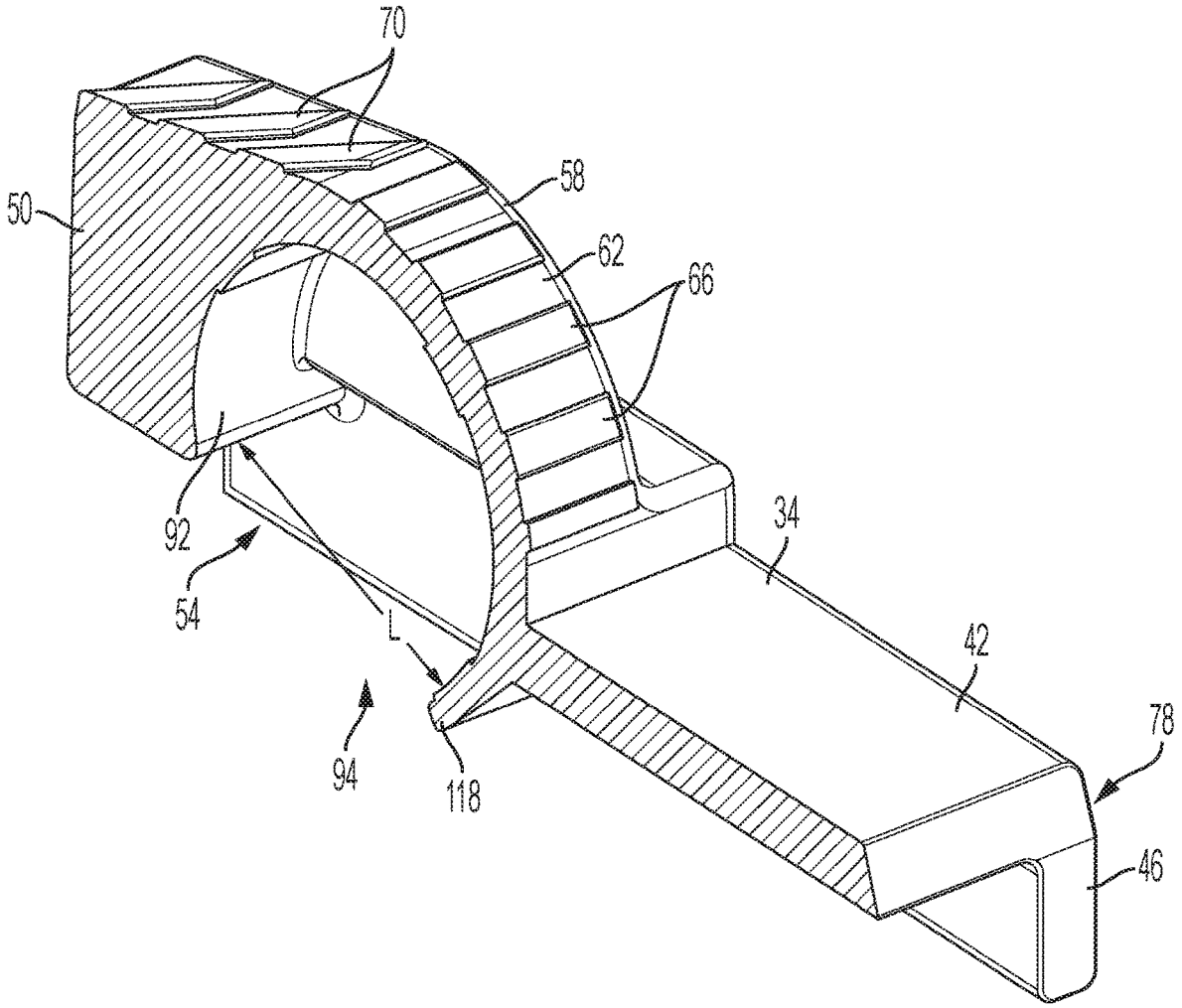
FIG. 6 is a section view of the staple pusher.
Figure 7:
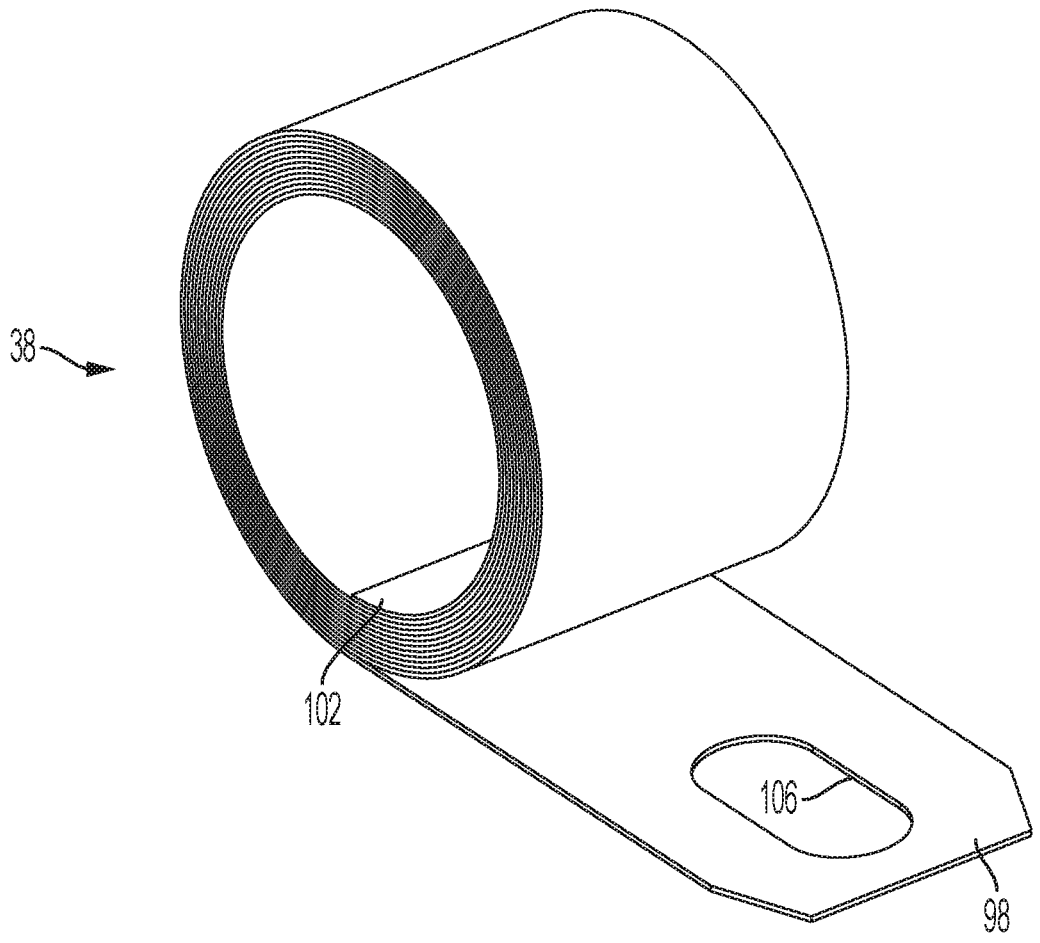
FIG. 7 is a perspective view of the constant force spring.
Figure 9:
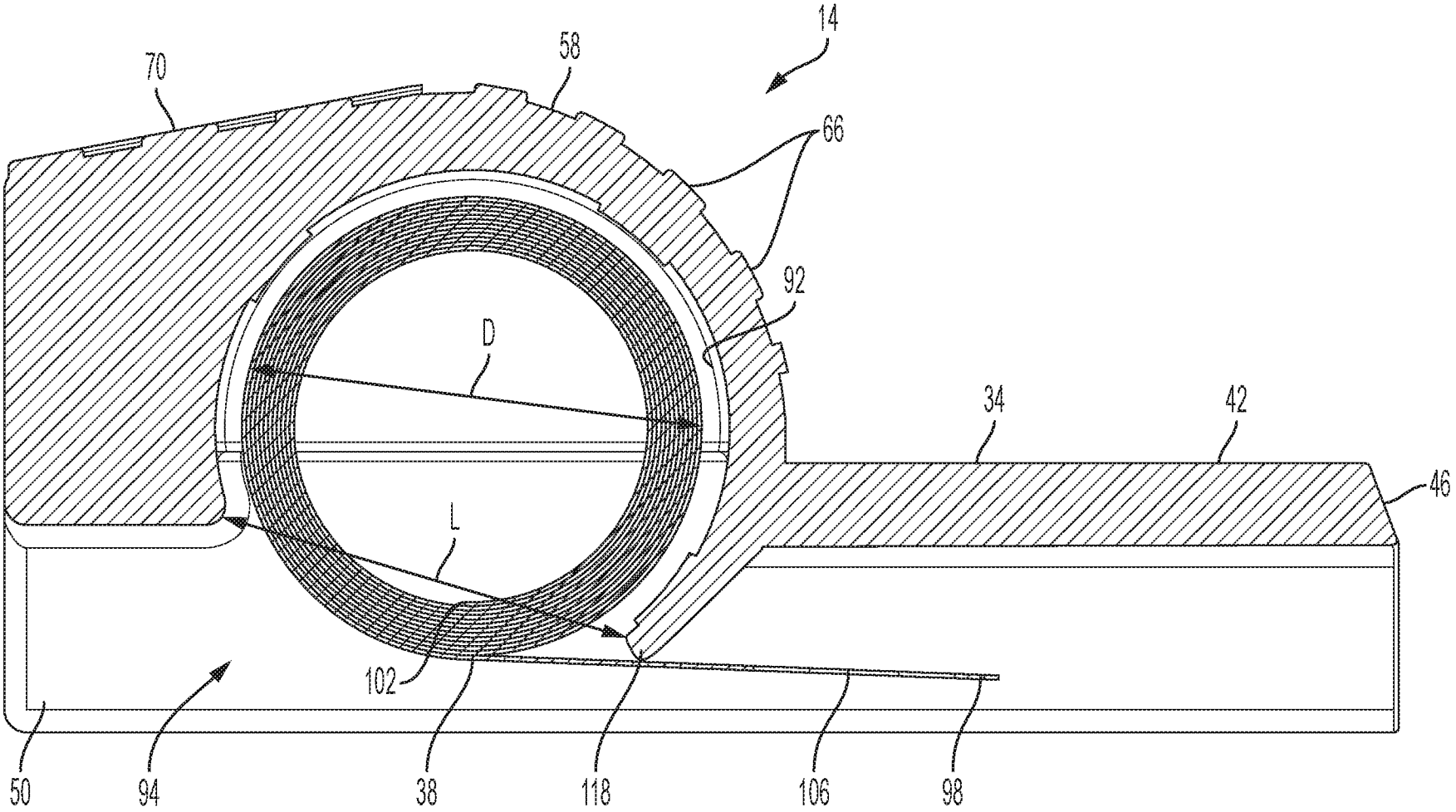
FIG. 9 is a side section view showing the constant force spring installed in a cavity of the staple pusher.

The illustrated staple pusher 34 is a molded plastic part. The cavity 54 is formed in the underside of the pusher 34 during molding, but in other embodiments or with other manufacturing techniques, the cavity 54 could alternatively be machined or otherwise formed using material removal techniques or by making the pusher 34 in two halves. The illustrated cavity 54 is provided in the second end portion 50, and more specifically within the enlarged portion 58 beneath the engagement surface 62 and between the sides 78. As best seen in FIGS. 6 and 9, the cavity 54 is generally circular in shape, having an upper cavity wall 92 that forms a portion of a circle. The upper cavity wall 92 is interrupted in a lower portion to provide an entrance or opening 94 into the cavity 54. The opening 94 has an opening length L that is sized to be smaller than a diameter D of the constant force spring 38 when the spring 38 is in its natural coiled condition or configuration, with most of the spring 38 coiled, as shown in FIG. 9. As seen from the figures, there is no shaft or projection within the cavity 54 on which the coiled portion of the constant force spring 38 is supported. Instead, the natural or rest state of the coil, and its diameter D that is larger than the opening length L, maintains the spring 38 within the cavity 54. This enables the spring 38 and the pusher 34 to be pre-assembled and maintained as a unitized pusher assembly 14, thereby facilitating shipping, storing, and assembly/installation.

The constant force spring 38 has a first end or non-coiled end 98 configured to be coupled to the magazine 22, and a second end 102 that is coiled within the cavity 54 in the staple pusher 34 when the spring 38 is in its natural or rest state. The constant force spring 38 is a flat metal strip that is naturally urged into the illustrated coiled state, but that can uncoil to provide a constant biasing force that urges the spring 38 back into its coiled state. The constant force spring 38 works well in the staple pusher assembly 14 because, unlike more commonly-used extendable torsion/traction springs, the spring 38 will provide a constant force urging the staple pusher 34 toward the first end 30 of the magazine 22, regardless of the number of staples S present in the magazine 22.

Figure 3:
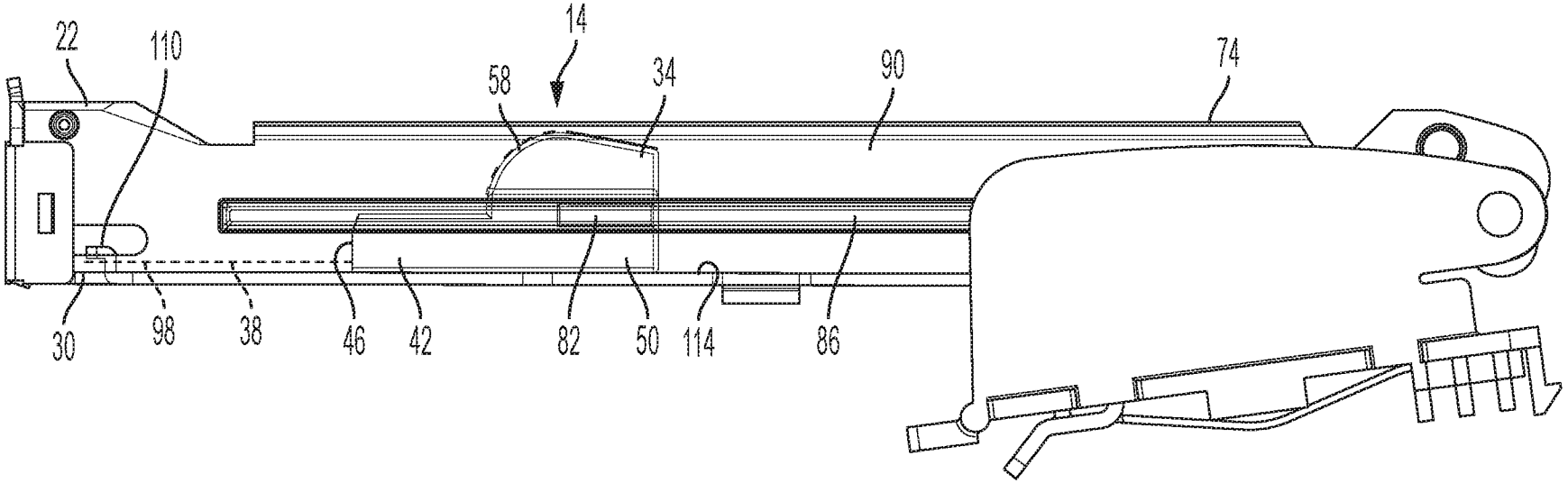
FIG. 3 is a side view of the pusher assembly installed in the magazine.
Figure 4:
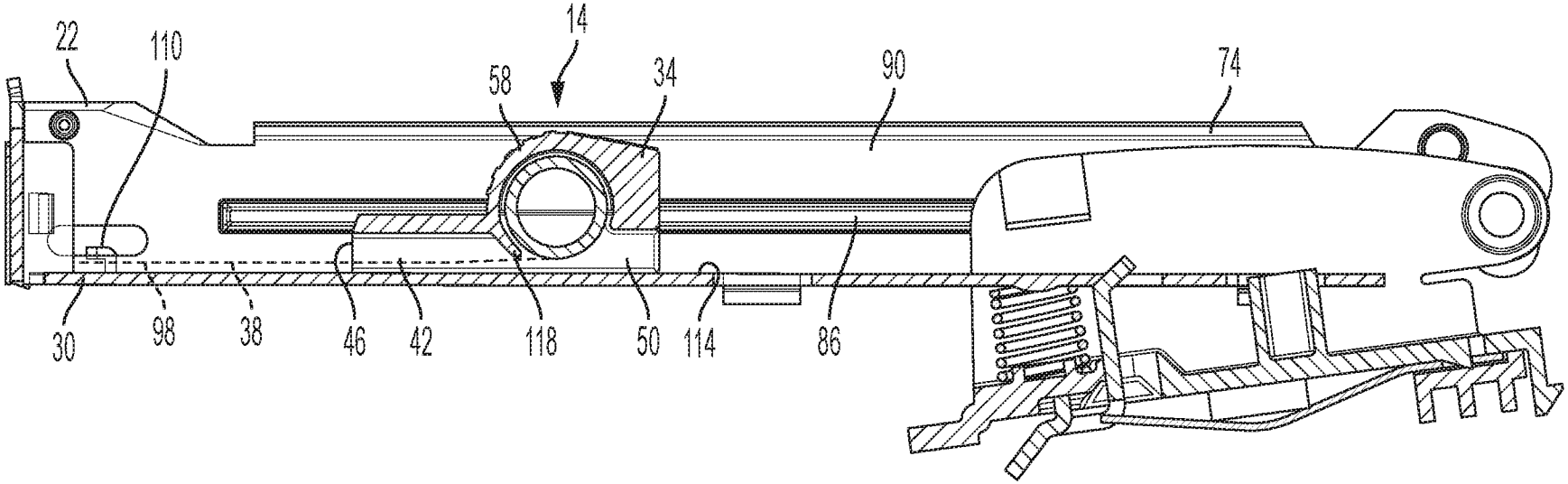
FIG. 4 is a partial section view of the pusher assembly installed in the magazine.
Figure 5:
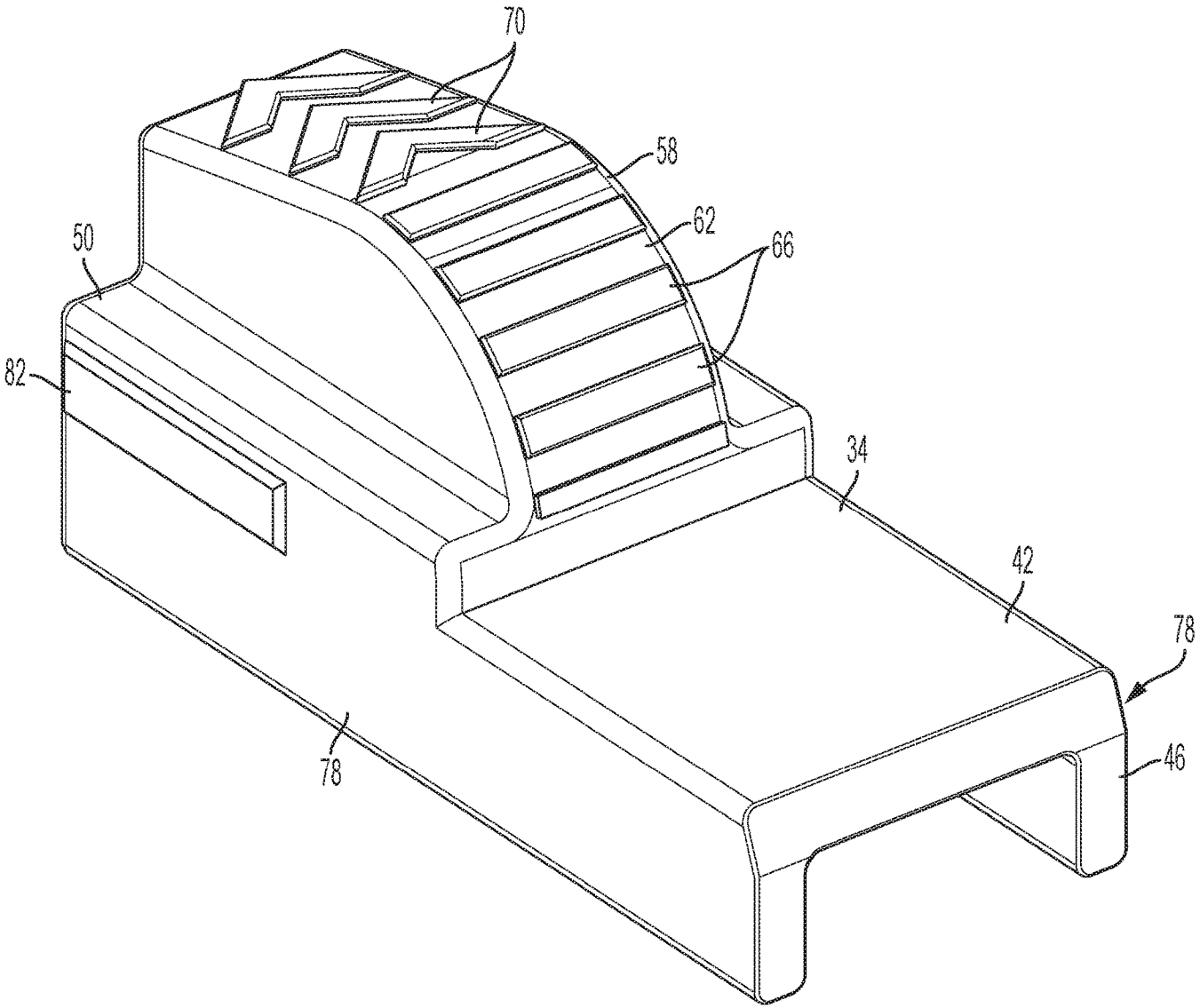
FIG. 5 is a perspective view of the staple pusher.

The first end 98 of the spring 38 includes an aperture 106 formed therein to engage and fix the first end 98 of the constant force spring 38 relative to the magazine 22. In the embodiment of FIGS. 1-9, the aperture 106 is an elongated slot that receives a projection 110 formed on the magazine 22 to fix the first end 98 of the constant force spring 38 to the magazine 22. As best shown in FIGS. 3 and 4, the illustrated projection 110 can be a hook, tab, or other feature formed in or coupled to the magazine 22, and in the illustrated embodiment, is a hook formed during the punching/forming operation of the magazine 22. The projection 110 extends from or is coupled with a bottom wall 114 of the magazine 22 beneath the staples S. In other embodiments, the manner of coupling or fixing the first end 98 of the spring 38 to the first end 30 of the magazine 22 can vary depending upon the magazine configuration.

Figure 8:
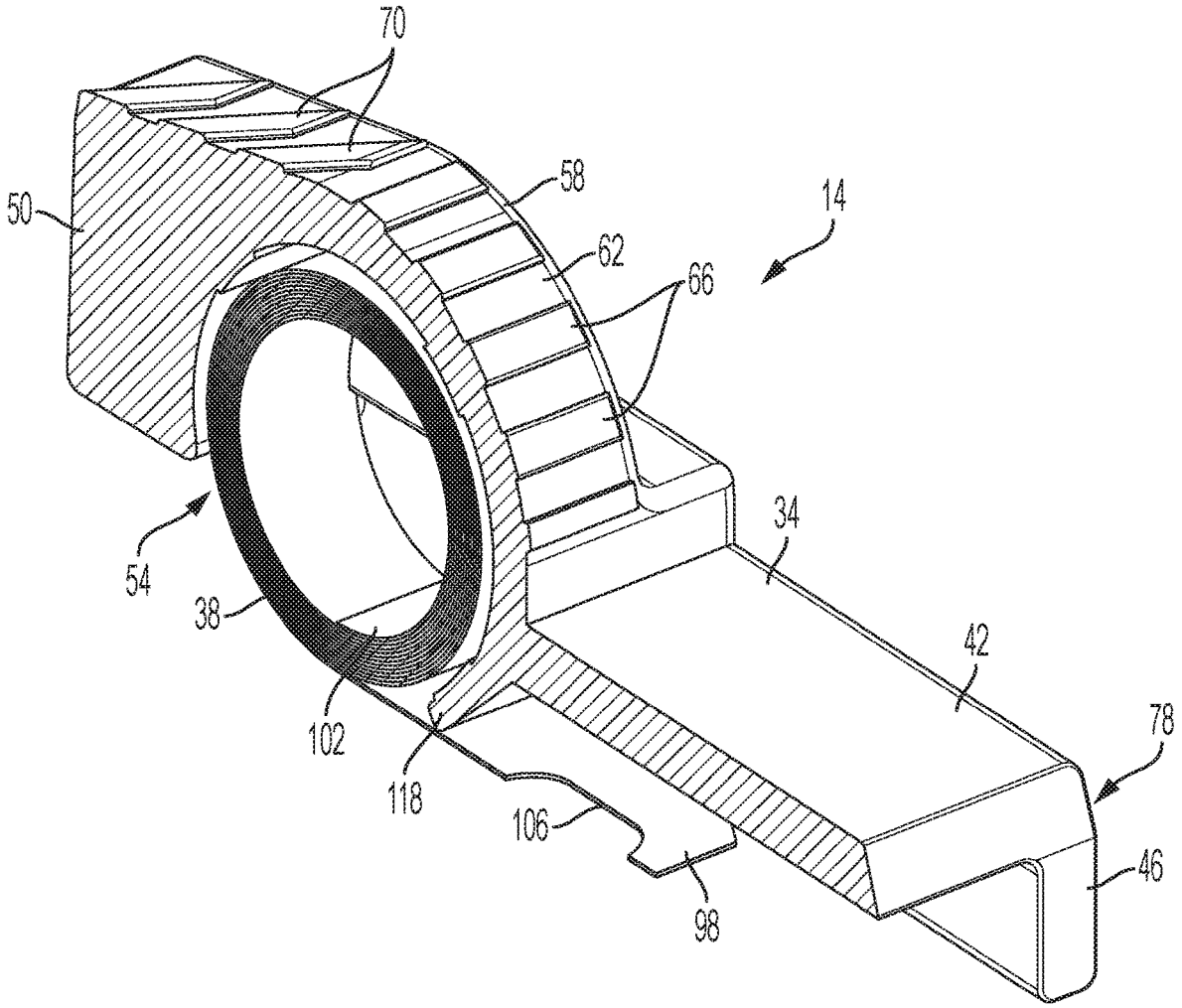
FIG. 8 is a perspective section view showing the constant force spring installed in a cavity of the staple pusher.

Installation and operation of the pusher assembly 14 will now be described. First, the constant force spring 38 is installed into the cavity 54 in the staple pusher 34. The user grasps the coiled spring 38 and squeezes the coil to deform the circular shape into a more elliptical shape that allows the coiled spring 38 to be inserted into the cavity 54 through the opening 94. After insertion, the coiled spring 38 will return to its rest state, such that its diameter D is larger than the opening length L to maintain the spring 38 in the cavity 54. Again, no shaft or other projecting feature is needed in the cavity 54 to pass through the center of the coil and retain it in the cavity 54. The first end 98 of the spring 38 can be positioned adjacent the opening 94, or can remain outside the cavity 54 (perhaps with a temporary retention device—e.g., tape), extending toward the first end portion 42 of the pusher, as shown in FIGS. 8 and 9. With the spring 38 installed in the pusher 34, the pusher assembly 14 is now unitized for handling and installation as a single unit.

The pusher assembly 14 is then installed into the magazine 22 as follows. Preferably, the installer first grasps and pulls the first end 98 of the spring 38 from beneath the pusher 34 so that the aperture 106 is exposed and accessible. The first end 98 of the spring is then coupled to the first end 30 of the magazine 22 by placing the aperture 106 over the projection 110 so that the first end 98 of the spring is hooked and retained by the projection 110 in the manner shown in FIGS. 3 and 4. Next, the installer aligns the pusher 34 between the side walls 90 of the magazine 22 and presses the pusher 34 into the magazine 22. The projections 82 on the sides 78 of the pusher 34 will interfere with the side walls 90 of the magazine, but continued pressure by the installer will cause the pusher 34 to deform slightly, with the sides 78 deflecting slightly toward one another (as permitted by the resiliency in the plastic material and the presence of the cavity 54) until the pusher 34 snaps into the magazine 22, and specifically, the projections 82 snap into their respective channels 86 in the side walls 90. The pusher assembly 14 is now installed in the magazine 22. It should be understood that the sequence of the installation technique can be altered in some variations, with the pusher 34 being installed into the magazine 22 before the first end 98 of the spring 38 is coupled to the magazine. However, such an alternate sequence may not be as easy as the preferred technique.

The user of the stapler 10 can load staples S into the magazine 22 by moving or sliding the pusher 34 toward the second end 74 of the magazine 22. Placing a finger or thumb on the engagement surface 62 and exerting force toward the second end 74 of the magazine 22 causes the spring 38 to uncoil within the cavity 54, thereby allowing the pusher 34 to slide within the magazine 22 as guided by the interaction between the projections 82 and the channels 86. The smooth, low-friction surface of the cavity wall 92 facilitates uncoiling of the spring 38. The uncoiled portion of the constant force spring 38 is adjacent the bottom wall 114 of the magazine 22 so that it will be positioned beneath staples S in the magazine 22 (e.g., between the opposed staple legs and aligned with the crown of the staple S). A forward distal end 118 (see FIGS. 4, 8, and 9) of the cavity wall 92 is operable, in cooperation with the projection 110, to limit the height of the uncoiled portion of the spring 38 above the bottom wall 114 to help keep the spring beneath the staples S and near the bottom wall 114 of the magazine 22.

The user then inserts a strip of staples S into the magazine 22 between the first end 30 of the magazine 22 and the distal end 46 of the pusher 34. Once the staple strip S is installed, the user releases the force on the engagement surface 62. The spring 38 then re-coils under its constant force, causing the pusher 34 to slide within the magazine 22 toward the first end 30 until the distal end 46 of the pusher 34 abuts the nearest staple S. The biasing force of the partially-uncoiled spring 38 urges the pusher 34, and therefore the staples S, toward the front end 30 of the magazine 22 as the staples are discharged from the magazine 22 during use of the stapler 10. The force applied by the pusher assembly 14 on the staples S remains constant, regardless of the number of staples remaining in the magazine 22, until all the staples S have been used. The user can then repeat the above procedure to load more staples S.

While the use of constant force springs in staple pusher assemblies has been known, it is believed that such prior art arrangements have all mounted or secured the large coiled end of the constant force spring adjacent the front end of the magazine, requiring added space in the front of the stapler for this coil. By positioning the coiled end 102 of the constant force spring 38 beneath and within the pusher 34, which is housed within the magazine 22, space savings is achieved. Furthermore, the pusher spring 38 is largely hidden from and inaccessible to the users. Additionally, the unitized pusher assembly 14 is easier to ship, store, and install than prior art constant force spring pusher assemblies, which typically require more and/or separate parts, a more complex stapler design, and/or more difficult and time-consuming installation procedures. The illustrated constant force spring arrangement is also quieter than helicoidal compression/torsion springs.

Figure 10:
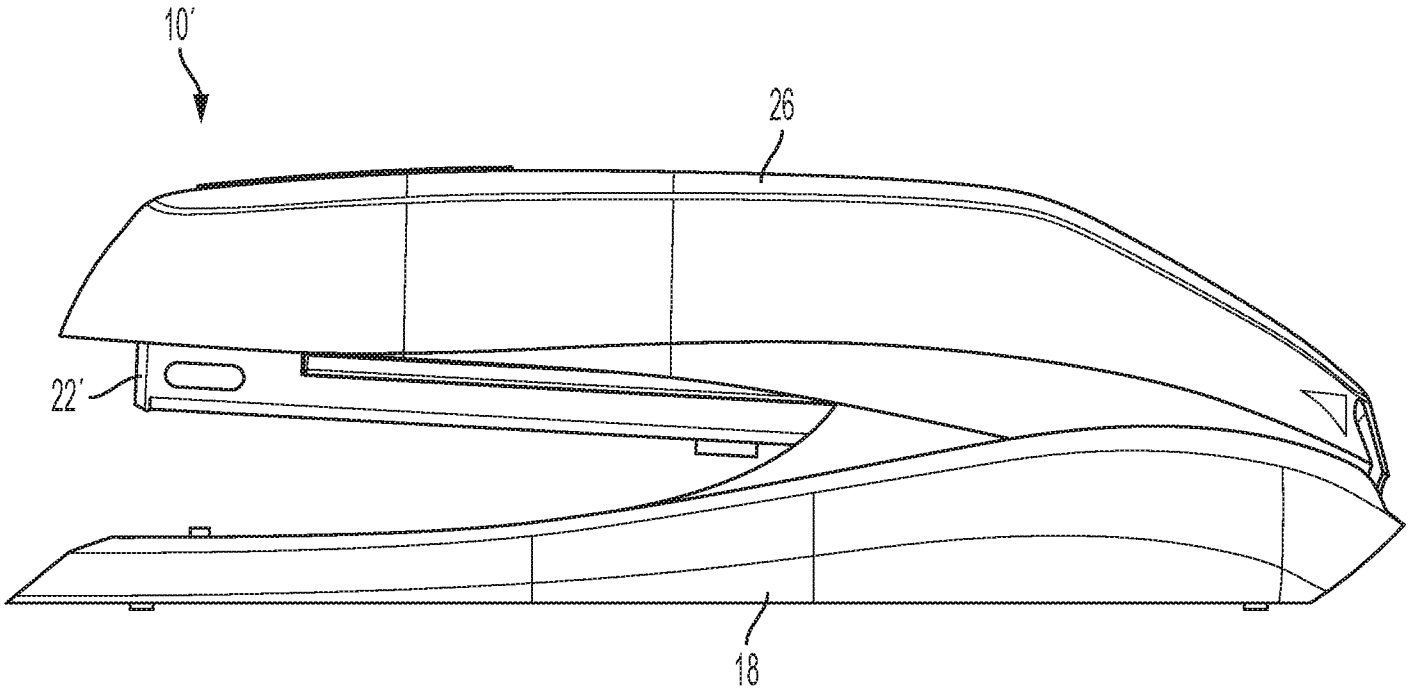
FIG. 10 is a side view of a stapler having another pusher assembly embodying the present invention.

FIGS. 10-16 illustrate another embodiment of a staple pusher assembly 14' according to the present invention. Like parts have been given like reference numerals, and only the differences from the pusher assembly 14 will be discussed below. Unless specifically described as differences below, like parts with like reference numerals have the features and characteristics previously described above. The stapler 10' of FIG. 10 is not significantly different from the stapler 10 of FIG. 1 except for a modification to the magazine 22' to cooperate with the coupling member 126, as will be discussed in detail below.

Figure 11:
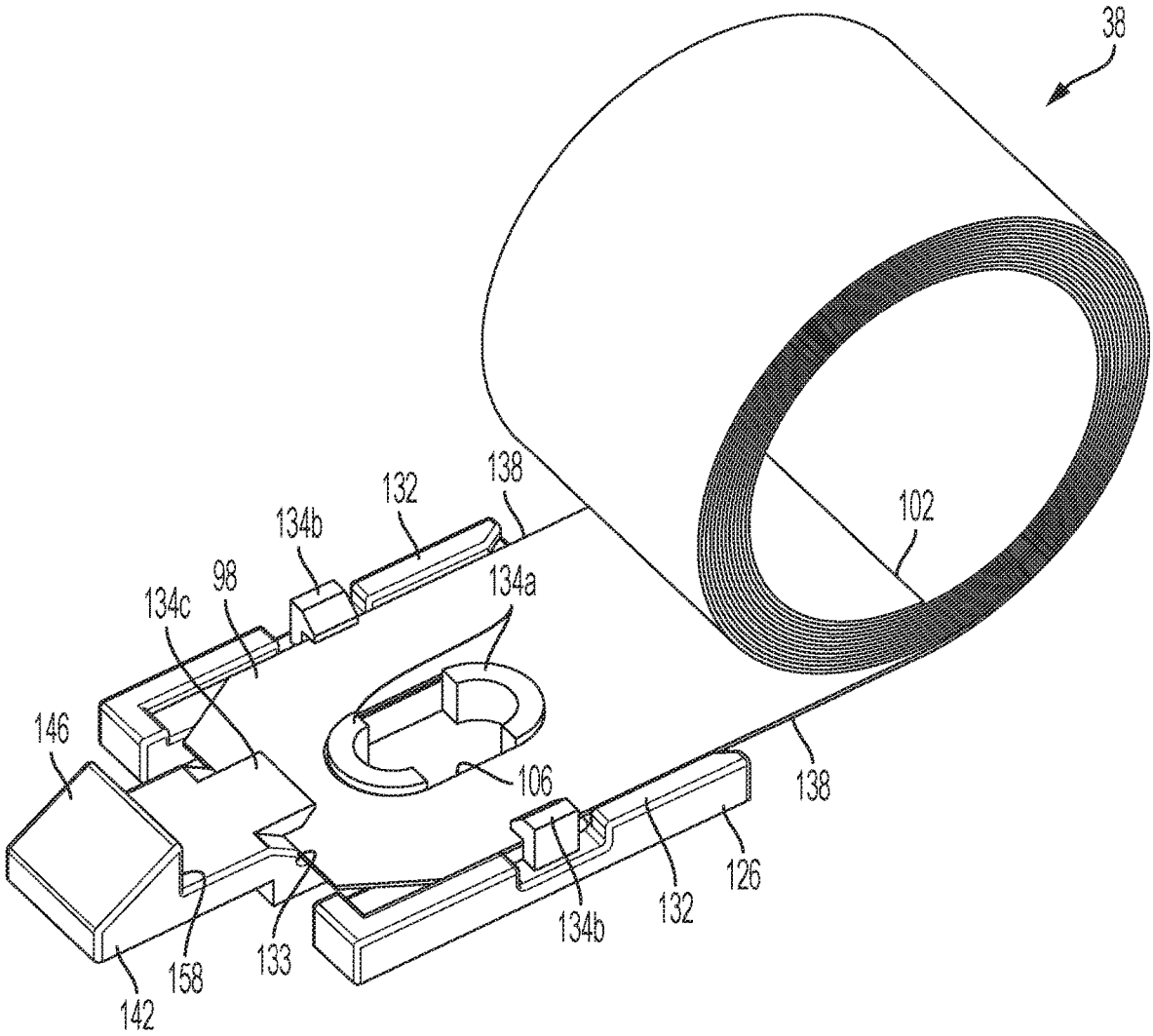
FIG. 11 is a perspective view of the constant force spring with a coupling member secured to the first end.
Figure 12:
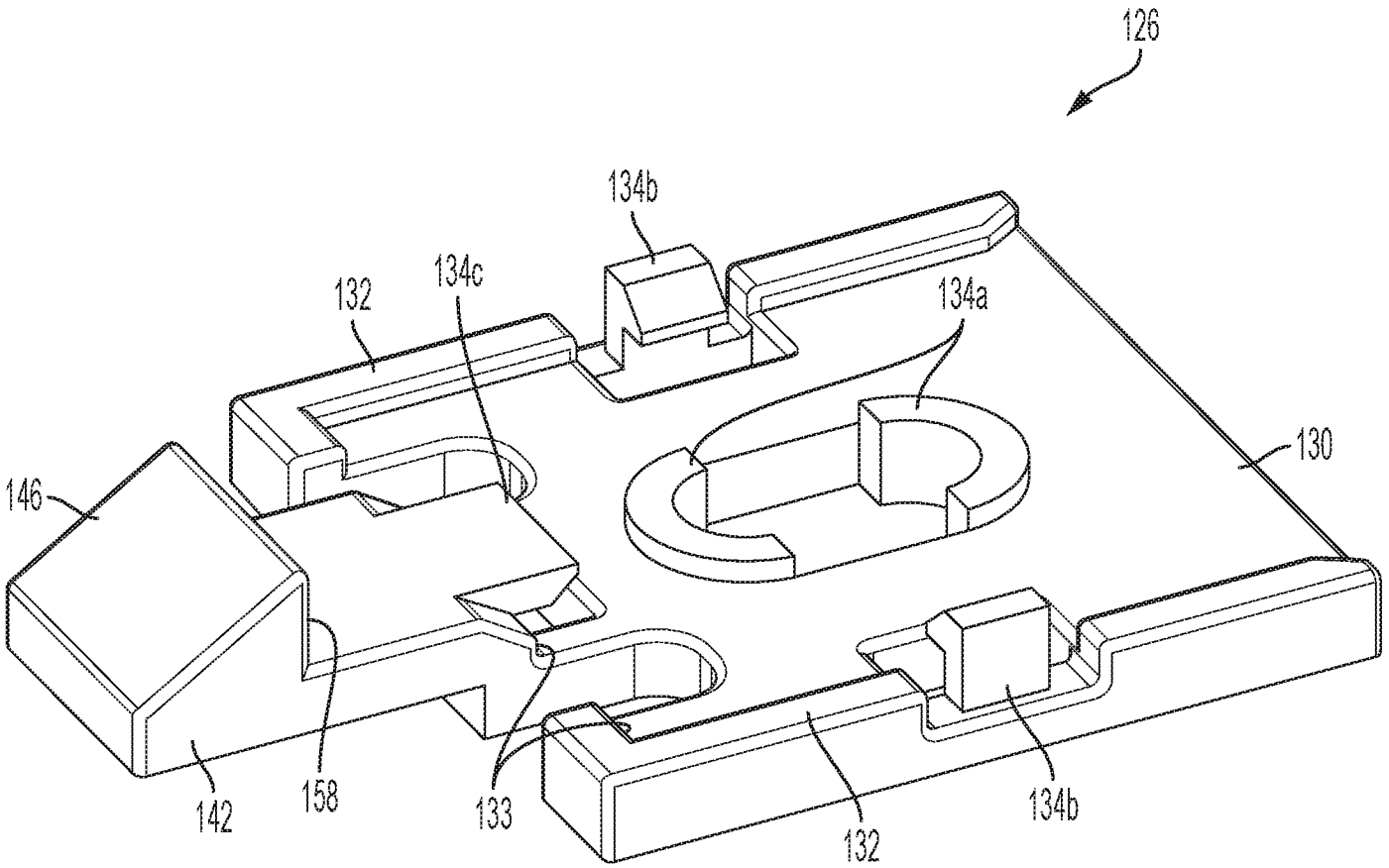
FIG. 12 is a perspective view of the coupling member of FIG. 11.

In addition to the pusher 34 and the constant force spring 38, the pusher assembly 14' further includes a coupling member 126 that can facilitate installation of the pusher assembly 14' into the magazine 22' of the stapler 10'. With reference to FIGS. 11 and 12, the illustrated coupling member 126 is a molded plastic part designed to be secured to the first end 98 of the spring 38 to facilitate installation of the pusher assembly 14' into the magazine 22' during stapler assembly. The coupling member 126 includes a base or support surface 130 sized and configured to support a lower or underside surface of the first end 98 of the spring 38. Side walls 132 and end wall 133 extend from the support surface 130 to define a channel in which the first end 98 is received. The coupling member 126 includes one or more projections 134*a*, 134*b*, and 134*c* for engaging the first end 98 of the spring 38 to secure the coupling member 126 to the first end 98. The projections 134*a* extend from the support surface 130, are sized and configured to at least partially conform to the shape of the aperture 106 in the first end 98, and are received in the aperture 106. The projections 134*b* are positioned adjacent the opposite side walls 132, are sized and configured to engage opposite edges 138 of the first end 98, and as illustrated, are resilient tabs that can deflect outwardly away from one another upon installation of the first end 98 onto the support surface 130 (due to their sloped upper surfaces) until they snap back into position over the opposite edges 138 to retain the spring 38. The projection 134*c* is adjacent the end wall 133 and receives the very distal end of the first end 98 to hold it against the support surface 130.

To install the first end 98 onto the coupling member 126, the distal end of the first end 98 is slid into position between the projection 134*c* and the support surface 130 until it abuts the end wall 133. Next, the first end 98 is pivoted downwardly toward the support surface 130. As this occurs, the projections 134*b* resiliently deflect away from one another to allow the first end 98 to continue its pivoting motion toward the support surface 130. At the same time, the projections 134*a* enter the aperture 106. Finally, the projections 134*b* will snap back over the edges 138 to prevent the first end 98 from lifting off of the support surface 130. The projections 134*a* in the aperture 106 prevent removal of the coupling member 126 by preventing any relative sliding movement in a longitudinal direction of the spring 38 and the coupling member 126. It should be understood that the illustrated arrangement of the projections 134*a*, 134*b*, and 134*c* is just one potential manner of securing the coupling member 126 to the first end 98 of the spring 38, and that other arrangements can also be used.

Figure 14:
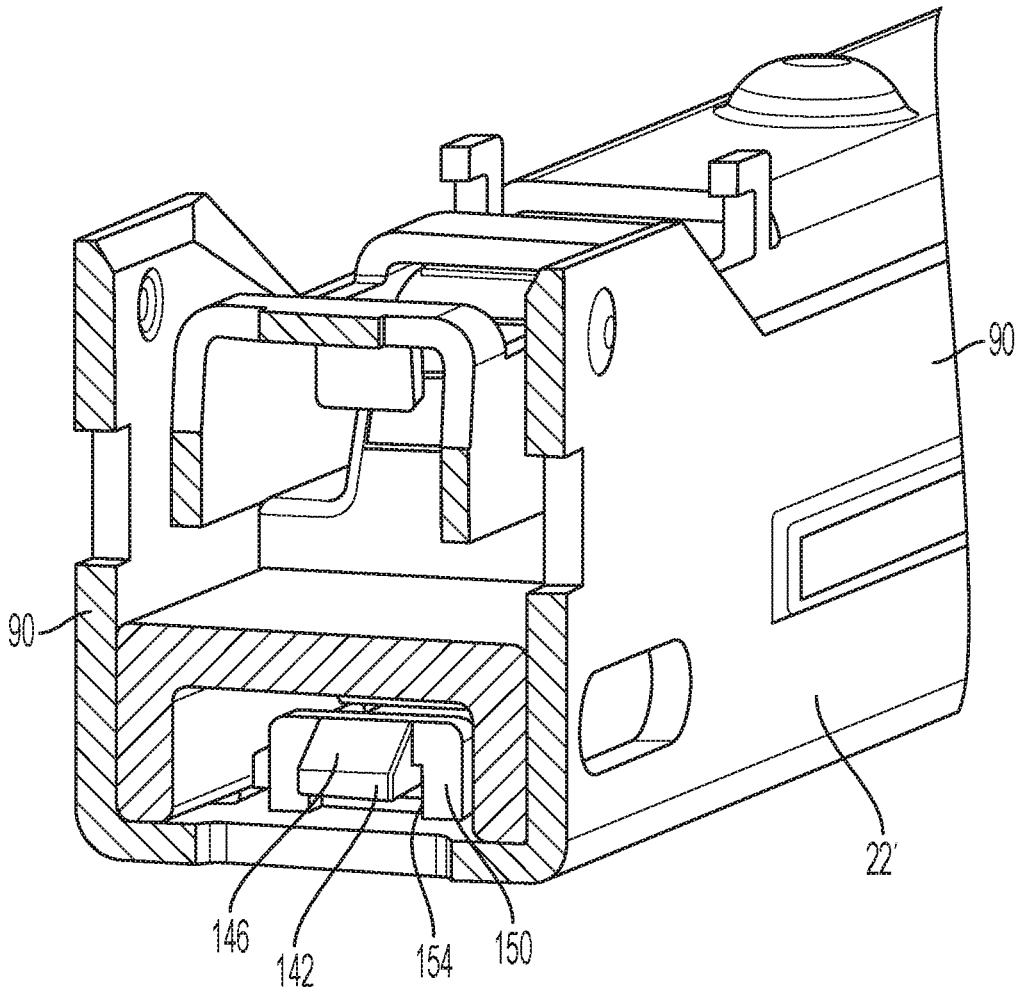
FIG. 14 is a partial section view showing the coupling member coupled to the magazine.
Figure 15:
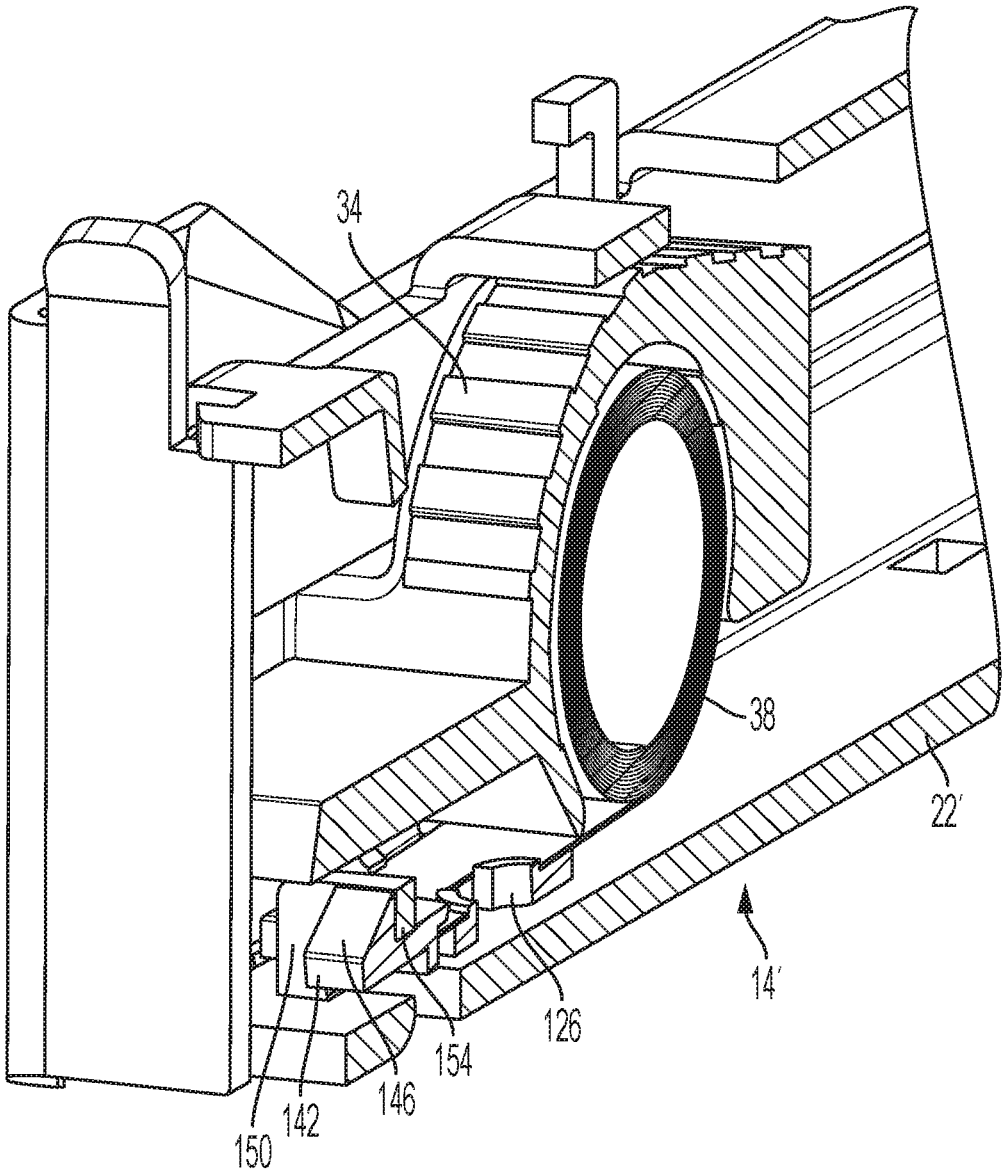
FIG. 15 is a partial section view showing the staple pusher assembly installed in the magazine.
Figure 16:
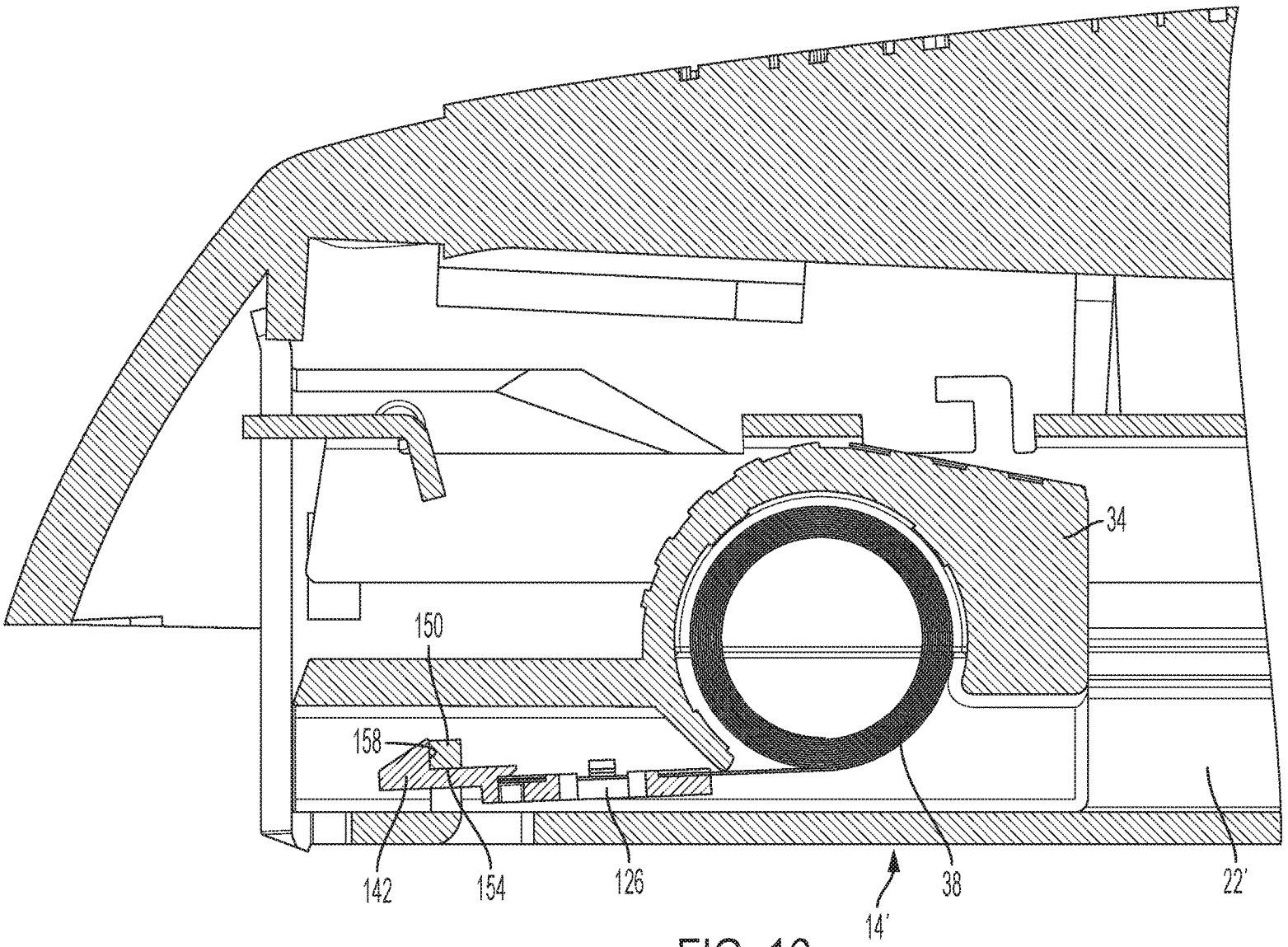
FIG. 16 is another partial section view showing the staple pusher assembly installed in the magazine.

The coupling member 126 also includes a projection 142 for engaging the magazine 22' to secure the coupling member 126, and therefore the spring 38, to the magazine 22'. The illustrated projection is a resilient tab that extends away from the end wall 133 and toward the front of the stapler 10' when installed. The projection 142 includes a sloped surface 146 configured to cause deflection of the projection 142 when the sloped surface 146 engages a flange 150 formed on or coupled with the magazine 22'. FIGS. 14-16 illustrate the engagement between the projection 142 and the flange 150. As shown in FIG. 14, the illustrated flange 150 includes an aperture 154 through which the front end of the projection 142 can pass. The sloped surface 146 engages the upper edge of the aperture 154 as the projection 142 is moved forwardly in the magazine 22', such that the projection 142 is deflected downwardly and can further extend through the aperture 154. The projection 142 also includes a shoulder 158 adjacent the sloped surface 146 such that once the projection 142 passes far enough through the aperture 154 in the flange 150, the projection 142 snaps back (upwardly in the figures) so that shoulder 158 abuts the flange 150 and prevents movement of the coupling member 126 toward the rear of the stapler 10'. In this position, the projection 142 secures both the coupling member 126 and the spring 38 relative to the magazine 22'. It should be understood that the illustrated arrangement of the projection 142 and the flange 150 is just one potential manner of securing the coupling member 126 to the magazine 22', and that other arrangements can also be used.

Figure 13:
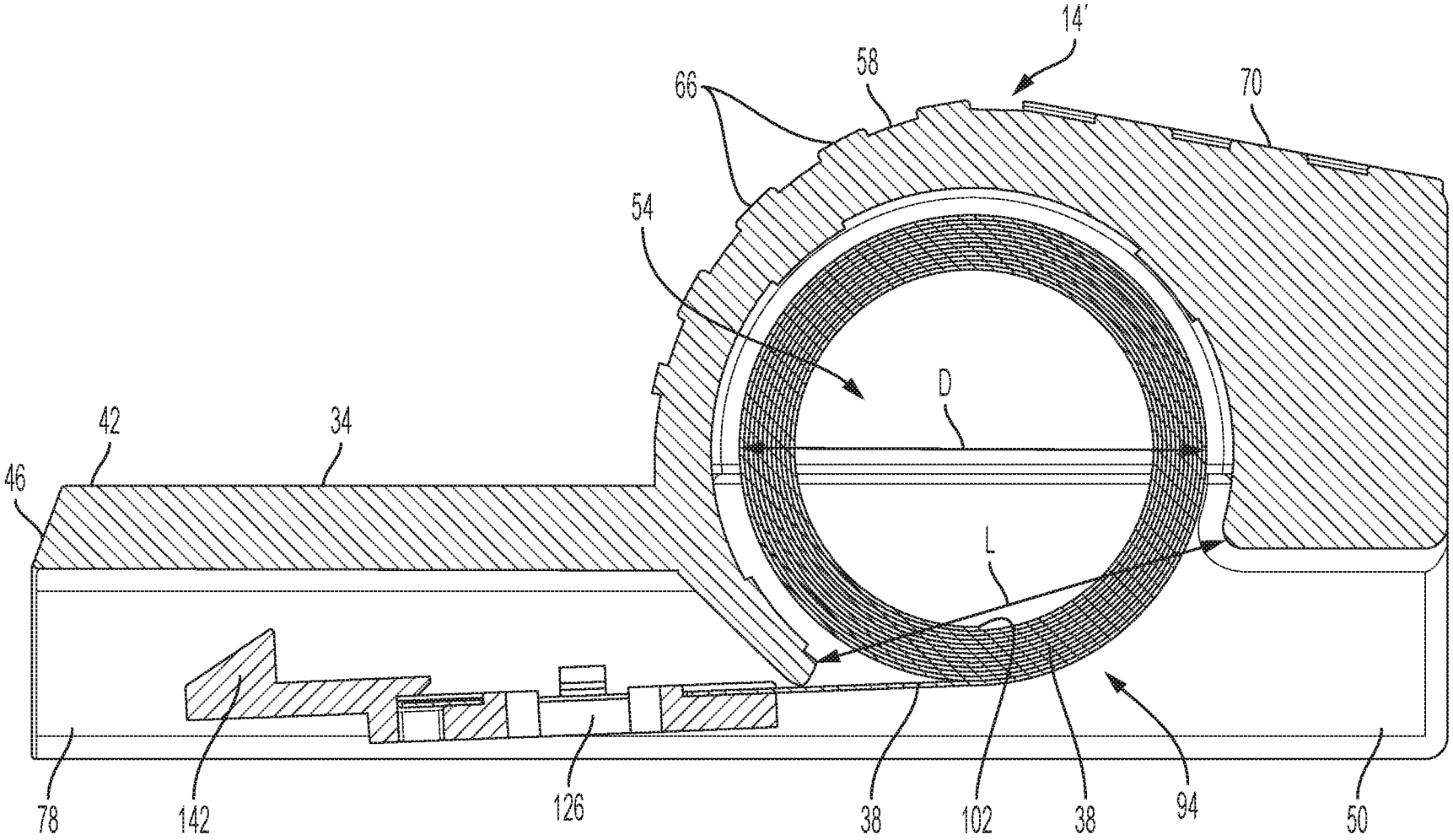
FIG. 13 is a side section view showing the constant force spring and coupling member installed in the staple pusher.

Assembly and installation of the pusher assembly 14' will now be described. The pusher assembly 14' is first partly constructed by snapping the coupling member 126 onto the first end 98 of the spring 38 in the manner described above. Next, the spring 38 (with the attached coupling member 126) is installed into the cavity 54 in the staple pusher 34 in the manner described above with respect to the pusher assembly 14. As shown in FIG. 13, the coiled end 102 of the spring 38 is housed or positioned in the cavity 54, while the coupling member 126 and first end 98 are housed or positioned forwardly of the cavity 54 snugly between the sides 78 of the pusher 34. In this state, the pusher assembly 14' is a unitized component that can be handled as a single unit for installation into the magazine 22'.

The assembler next aligns the pusher 34 between the side walls 90 of the magazine 22' and presses the pusher 34 into the magazine 22' in the same manner discussed above for the pusher assembly 14 to secure the pusher assembly 14' between the side walls 90 of the magazine 22'. Next, the assembler slides the pusher 34 forwardly within the magazine 22' such that the coupling member 126 moves with the pusher 34 toward the flange 150 at the front of the magazine 22'. Continued movement of the pusher 34 toward the front of the magazine 22' will bring the projection 142 into engagement with the flange 150 and cause the deflection of the projection 142 as described above until the projection 142 snaps into its secured position with the shoulder 158 abutting the forward-facing surface of the flange 150. The installation of the pusher assembly 14' is thereby complete.

The coupling member 126 facilitates the connection of the spring 38 to the flange 150 of the magazine 22' (or a similar fixed feature of the stapler 10') because the assembler need not manually grasp, position, or manipulate the coupling member 126 or the first end 98 of the spring 38 to secure them to a fixed feature of the stapler 10'. Instead, the configuration and orientation of the coupling member 126 along the underside of the pusher 34 allows for an automatic securement, engagement, and connection between the projection 142 and the flange 150 simply by moving the pusher 34 to the front of the magazine 22'. The rigidity of the spring 38 and the coupling member 126 in the longitudinal direction (i.e., the direction of coiling and uncoiling of the spring 38) enables this automatic engagement with the mere movement of the pusher 34 toward the front of the stapler 10'. An audible click will be heard when the projection 142 snaps into place against the flange 150, thereby letting the assembler know the connection is achieved. The pusher assembly 14' then operates during use of the stapler 10' in the same manner described above with respect to the pusher assembly 14.

Various features and advantages of the invention are set forth in the following claims.

What is claimed is:

1. A stapler comprising:

a base;

a magazine coupled to the base and configured to house staples; and a staple pusher assembly coupled with the magazine and operable to bias staples in the magazine toward a first end of the magazine where staples are driven out of the magazine, the staple pusher assembly including a staple pusher defining a cavity; and a constant force spring having a first end coupled to the magazine and a second end that is coiled within the cavity in the staple pusher for movement with the staple pusher.

2. The stapler of claim 1, wherein the pusher includes a first portion configured to engage a strip of staples in the magazine and a second portion configured for engagement by a finger of a user of the stapler to move the pusher toward a second end of the magazine opposite the first end of the magazine, and wherein the cavity is formed in an underside of the second portion of the pusher.

3. The stapler of claim 2, wherein the pusher includes ribs for engagement with the finger of the user.

4. The stapler of claim 1, wherein the first end of the constant force spring includes an aperture formed therein to secure the first end of the constant force spring to the magazine.

5. The stapler of claim 1, wherein the staple pusher assembly further includes a coupling member secured to the first end of the constant force spring, the coupling member being coupled to the magazine to secure the first end of the constant force spring relative to the magazine.

6. The stapler of claim 5, wherein the first end of the constant force spring includes an aperture formed therein to secure the first end of the constant force spring to the coupling member.

7. The stapler of claim 5, wherein the coupling member includes a projection that engages the magazine.

8. The stapler of claim 7, wherein the projection is a resilient tab in abutment with a flange of the magazine.

9. The stapler of claim 5, wherein the coupling member includes at least one projection engaging the first end of the constant force spring to secure the first end to the coupling member.

10. The stapler of claim 1, wherein there is no shaft or projection within the cavity on which the coiled second end of the constant force spring is supported.

11. The stapler of claim 1, wherein the staple pusher further includes a projection extending from each one of oppositely facing sides of the pusher and received in respective channels formed in the magazine to guide sliding movement of the staple pusher within the magazine.

12. The stapler of claim 1, wherein the constant force spring is made from a flat metal strip that is biased toward a coiled configuration, and wherein an uncoiled portion of the constant force spring is adjacent a bottom wall of the magazine beneath staples in the magazine.

13. The stapler of claim 1, wherein the cavity includes an opening having an opening length L sized to be smaller than a diameter D of the constant force spring in a coiled configuration.

14. The stapler of claim 1, wherein the cavity is at least partly defined by a circular cavity wall.

15. The stapler of claim 14, wherein the circular cavity wall has a distal end that engages the constant force spring as the spring uncoils to limit a height of an uncoiled portion of the spring above a bottom wall of the magazine.

16. A stapler comprising:

a base;

a magazine coupled to the base and configured to house staples; and a staple pusher assembly coupled with the magazine and operable to bias staples in the magazine toward a first end of the magazine where staples are driven out of the magazine, the staple pusher assembly including a staple pusher defining a cavity; and a constant force spring having a first end coupled to the magazine and a second end that is coiled within the cavity in the staple pusher;

wherein the first end of the constant force spring includes an aperture formed therein to secure the first end of the constant force spring to the magazine.

17. A stapler comprising:

a base;

a magazine coupled to the base and configured to house staples; and a staple pusher assembly coupled with the magazine and operable to bias staples in the magazine toward a first end of the magazine where staples are driven out of the magazine, the staple pusher assembly including a staple pusher defining a cavity; and a constant force spring having a first end coupled to the magazine and a second end that is coiled within the cavity in the staple pusher;

wherein the staple pusher assembly further includes a coupling member secured to the first end of the constant force spring, the coupling member being coupled to the magazine to secure the first end of the constant force spring relative to the magazine; and wherein the first end of the constant force spring includes an aperture formed therein to secure the first end of the constant force spring to the coupling member.

* * * * *